US006280260B1

(12) United States Patent
Bertsch

(10) Patent No.: US 6,280,260 B1
(45) Date of Patent: Aug. 28, 2001

(54) CONNECTOR AND METHOD OF ASSEMBLING SAID CONNECTOR

(75) Inventor: Michael Bertsch, Heilbronn (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/277,206

(22) Filed: Mar. 26, 1999

(30) Foreign Application Priority Data

Mar. 26, 1998 (DE) ..... 198 13 479

(51) Int. Cl.[7] ..... H01R 13/40
(52) U.S. Cl. ..... 439/733.1
(58) Field of Search ..... 439/733.1, 660, 439/629

(56) References Cited

U.S. PATENT DOCUMENTS 4,425,015 * 1/1984 Rizzo ..... 339/17
4,780,098 * 10/1988 Seidler ..... 439/876
5,009,614 * 4/1991 Fogg et al. ..... 439/497
5,316,489 * 5/1994 Kachlic et al. ..... 439/79
5,727,957 * 3/1998 Hashimoto et al. ..... 439/79
5,816,841 10/1998 Grant .
6,004,160 * 12/1999 Korsunsky et al. ..... 439/660
6,083,051 * 6/2000 Chang ..... 430/660

FOREIGN PATENT DOCUMENTS 36 23 549 A1 1/1988 (DE) .
WO 93 14537 7/1993 (DE) .
44 39 262 5/1996 (DE) .

* cited by examiner

*Primary Examiner*—Gary F. Paumen
*Assistant Examiner*—P. Nguyen
(74) *Attorney, Agent, or Firm*—Blank Rome Comisky & McCauley, LLP

(57) ABSTRACT

A connector comprising a contact element support 12 and a plurality of contact elements 20, wherein said contact element support 12 comprises a first, e.g. upper surface provided with ribs 16 having walls 26 which define spaces 15 and a second, e.g. lower surface opposite said first surface and provided with recesses 25, and wherein each of said contact elements 20 comprises claws 44 adapted to cooperate with said walls 26 defining said spaces 15 and further comprises a mounting portion 30 adapted to cooperate with said recesses 25 provided in said second surface.

12 Claims, 4 Drawing Sheets

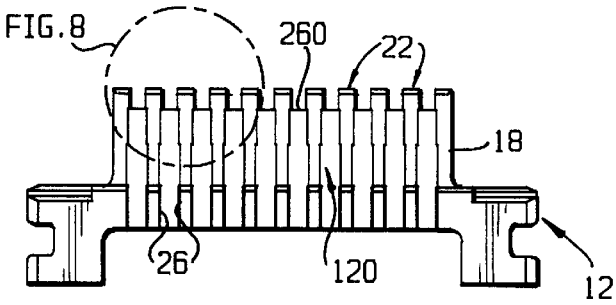
FIG.7
FIG.9
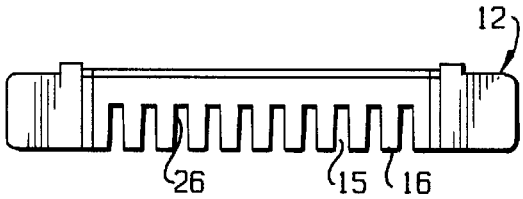
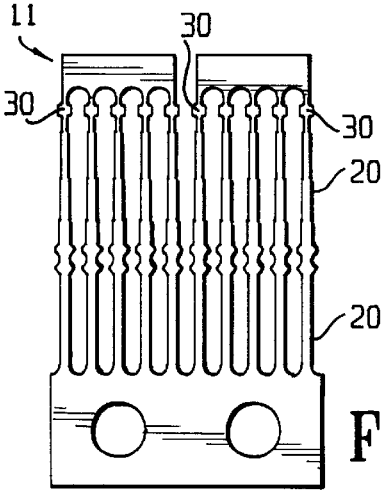
FIG.10
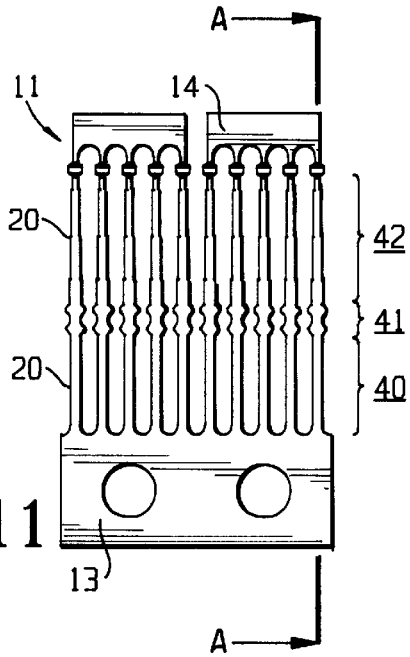
FIG.11
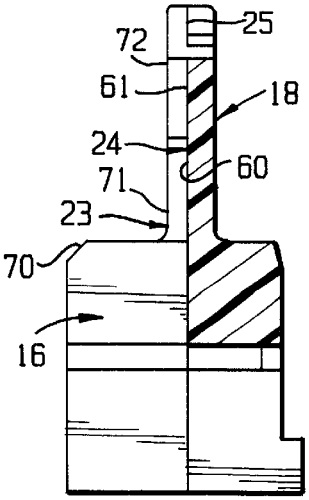
FIG.16

CONNECTOR AND METHOD OF ASSEMBLING SAID CONNECTOR

TECHNICAL FIELD

This invention relates generally to a connector and also to a method of assembling said connector. More specifically, the invention relates to a male connector.

BACKGROUND ART

Connectors typically comprise a contact element support made of an insulating material. Thus the contact element support is also called an insulating body. Said contact element support can be designed such that one contact element, preferably a plurality of contact elements forming a contact element comb, can be mounted at or in said contact element support. The contact elements are frequently fixedly mounted in or at said contact element support by embedding said contact elements in the contact element support at the time it is formed by injection molding of a plastic material.

When mounting contact elements in the contact element support by injection molding, various problems occur. For instance, the injection molding process is complicated because the contact elements have to be held in the proper location at the time the injection molding operation occurs.

The present invention is directed to overcoming the problems encountered in the prior art.

DISCLOSURE OF THE INVENTION

The present invention relates to a connector in general and in particular to a connector comprising a plurality of contact elements located in a common plane. Such a connector is preferably suitable for so-called cell phones. Cell phones require small size components and thus, the connector of the invention is designed such that it has a small size, in particular a small height. The connector of the invention uses for instance ten adjacently located contact elements covering a width of approximately 14 millimeters In one aspect of the present invention, the contact element support comprises on one of its sides, in particular at its upper surface, a comb-like design. Said comb is formed by a plurality of ribs. A comb of contact elements (contact element comb) can be inserted into the spaces or recesses between said ribs. Narrower sections of said contact elements are inserted in said recesses.

In accordance with the invention, the contact elements are formed such that they comprise besides said narrower sections wider sections which come into engagement with said ribs when the contact elements, preferably a complete comb of contact elements, is horizontally moved with respect to the contact element support. In this manner, the contact elements are fixedly mounted at an upper surface of said contact element support.

In another aspect of the present invention, each of said contact elements comprises an angled or off-set portion (shaped like a hammer). Said portion is moved during said horizontal movement of the comb of contact elements at the bottom surface of the contact element support into contact with abutment surfaces provided by the lower surface of said contact element support. Thus, each of the contact elements is secured with respect to a release of the contact element in vertical direction.

In accordance with another aspect of the invention, the assembly of the contact elements on the contact element support provides for an insertion of the comb of contact elements from above into the spaces between the ribs into the contact element support. After said insertion, the comb of contact elements is moved, as mentioned above, in a horizontal direction such that laterally extending wider sections (also called laterally extending claws) of said contact elements penetrate into the material forming said contact element support. Thus, said contact elements are fixedly mounted between said ribs at said contact element support.

Preferably, during the process of assembly, the contact elements are still connected at opposite sides to pilot strips. During said horizontal movement, said off-set or angled portions come into engagement with said contact element support (such that the contact elements are secured with respect to vertically applied forces) at the same time the lateral claws become engaged with the side walls of said ribs.

It is an advantage of the assembly method of the invention that the contact elements can remain connected with both their sides with respective pilot strips so that a good stability is achieved during assembly. Such stability is particularly important for small contact elements arranged with small pitch.

BRIEF DESCRIPTION OF THE DRAWINGS

FIG. 7 is a top plan view onto the upper surface of the contact element support of FIG. 2, but without contact elements, and with the contact element support being rotated by 180 degrees in the plane of the drawing with respect to FIG. 2;

FIG. 9 is a back view of the contact element support of FIG. 7;

FIG. 10 is a top plan view of a comb of contact elements comprising a plurality of contact elements which are connected at both their ends by a pilot strip;

FIG. 11 is a top plan view similar to FIG. 10, but where mounting portions (first mounting means of the contact element(s)) have been formed;

FIG. 16 is a section along line A—A in FIG. 15.

Figure 1:
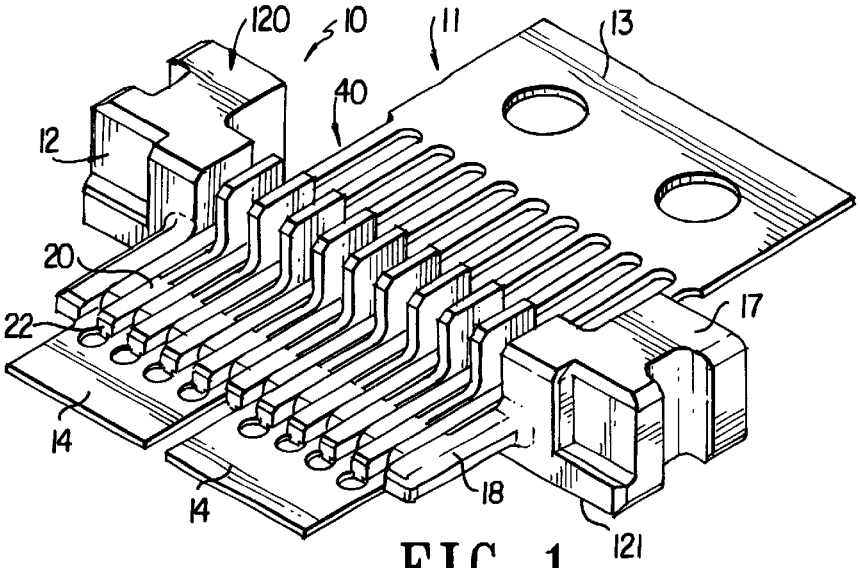
FIG. 1 is a perspective view of a connector of the invention shortly before being in its finished condition.
Figure 2:
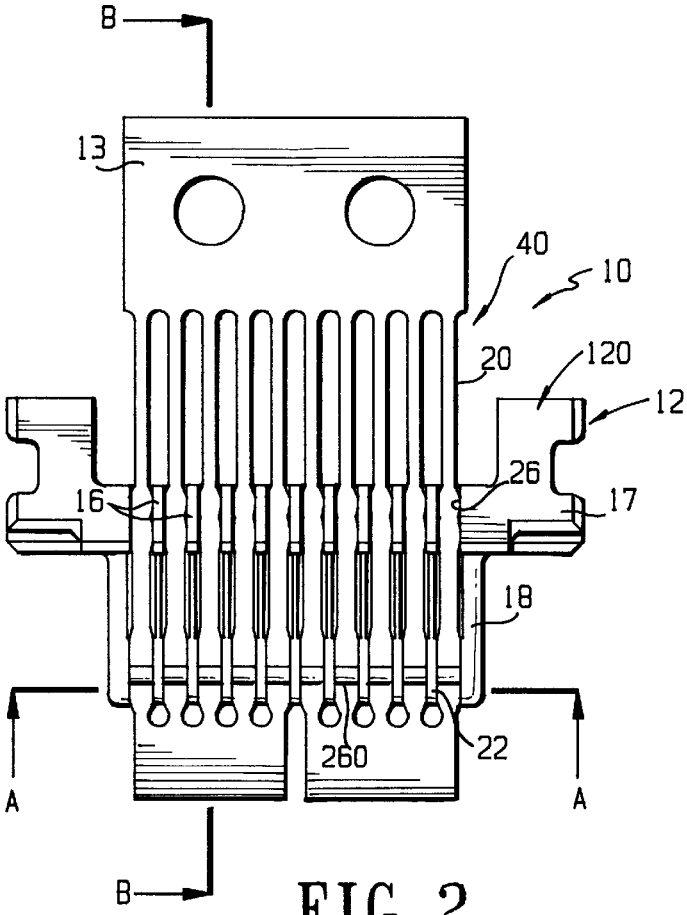
FIG. 2 is a top plan view of the connector of FIG. 1 showing the upper surface of said connector with the contact elements in the form of a comb of contact elements fixedly mounted in a contact element support, however, with the pilot strips of the contact elements not yet being removed.

An embodiment of a male connector 10 of the invention is shown in FIGS. 1 to 16.

The connector 10 comprising a contact element support 12 is shown in FIGS. 1 through 4 in its assembled condition, however, without showing the housing, and also prior to severing the two pilot strips 13, 14 of a comb 11 of contact elements 20. Frequently, the termination ends of the contact elements 20, i.e. ends which exit the connector 10 in FIG. 1 at the right side (adjacent pilot strip 13), are bent upwardly by about 90 degrees The connector 10 is adapted to receive a female counter-connector (not shown) from the left side in FIG. 1.

Figure 13:
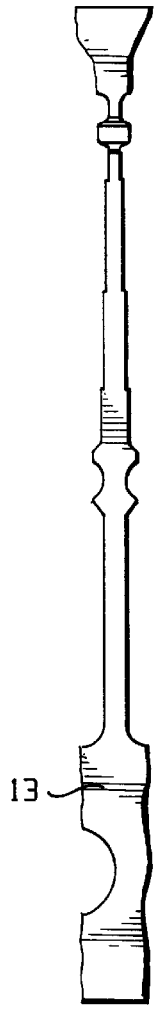
FIG. 13 is an individual contact element after the bending operation.
Figure 14:
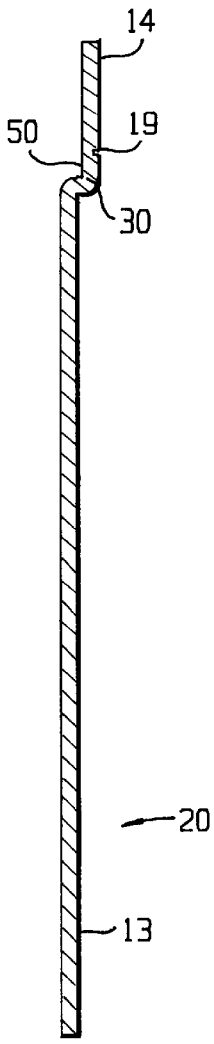
FIG. 14 is a longitudinal sectional view of the bent or "angled" contact element of FIG. 13.
Figure 15:
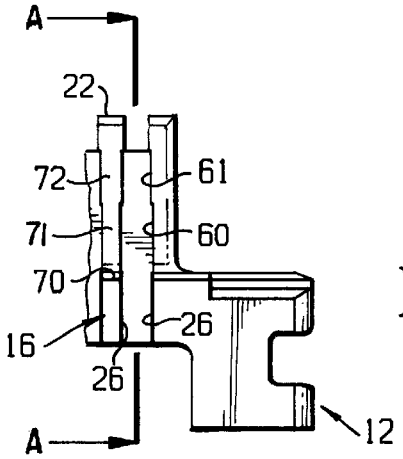
FIG. 15 is a detail of FIG. 7 of a part of the contact element support without a contact element being inserted.

In FIGS. 5 through 9 as well as FIGS. 15 through 16, details of the contact element support 12 of the connector 10 are shown. FIGS. 10 through 14 relate to details of the invention regarding the contact elements 20.

FIGS. 1 to 4 show that the contact element support 12 has a first or upper surface 120 which is provided with ribs 16 having walls 26 defining spaces or gaps 15 between said ribs 16. The contact element support 12 forms a support or mounting portion 17 carrying said ribs 16 and extending transversely with respect to extension of the ribs 16. A support portion 18 forms a single piece with said mounting portion 17 and projects away from said mounting portion 17 (see for instance FIG. 2) in a direction about perpendicular to the extension of said mounting portion 17. The contact element support also has a second or lower surface 121.

A plurality of elongate contact elements 20 is inserted, in a manner yet to be described, into said spaces 15S. The contact elements 20 are anchored within said spaces 15 as will be described below. The contact elements 20 rest upon the upper surface of the contact element support 12, in particular in the area of the ribs 16 and also in the area of the support portion 18. The contact elements 20 form in the area of the support portion 18 upwardly facing contact surfaces, for instance for said counter-connector. In the shown embodiment, the counter-connector would be a female connector.

Figure 3:
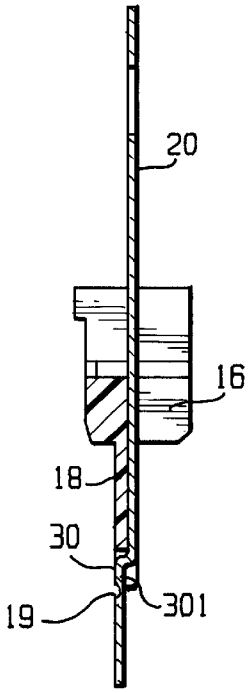
FIG. 3 is a sectional view along line B—B in FIG. 2.
Figure 4:
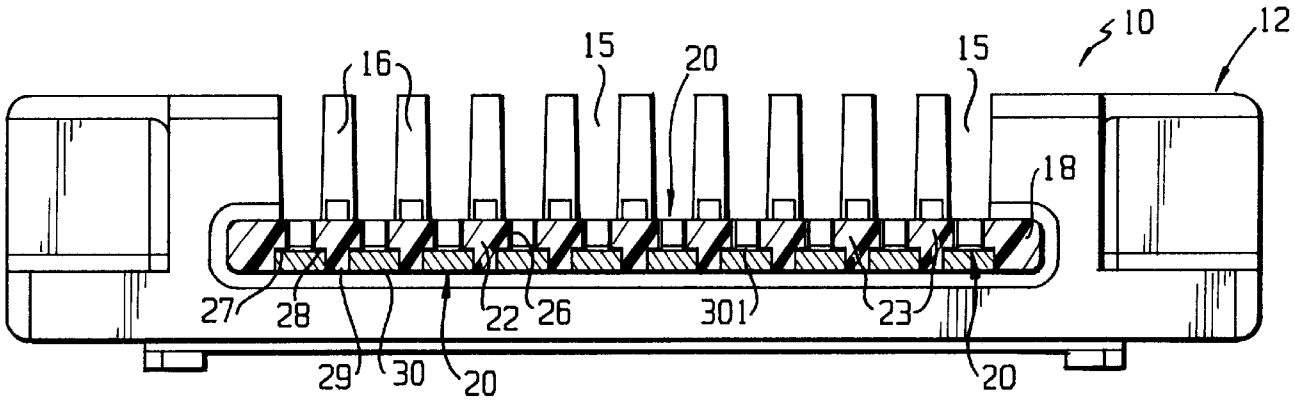
FIG. 4 is a sectional view along line A—A in FIG. 2.

First contact element mounting means in form of a mounting portion 30, preferably in the form of an extension or a widening 30 (FIG. 12) is formed by each of the contact elements 20 at one end thereof and adjacent to a notch 19 (see FIG. 3). Said mounting portion 30 is, as is shown in FIG. 3, placed in a plane different from the larger rest of the contact element 20 by a bending operation carried out on the contact element 20. Thus, the mounting portion or bent portion 30 is off-set with respect to the larger portion of the contact element, as is shown in FIG. 3. The mounting portion 30 allows to fixedly mount the contact element 20 also at the lower surface 121 of the connector 10, as is shown for instance in FIG. 4. Preferably, the mounting portion 30 allows the mounting of the contact element 20 at a lower surface 21 of the support portion 18- For this purpose, the lower surface 21 of the support portion 18 is provided with respective recesses 25 adapted to receive the mounting portions 30. The recesses 25 form abutment surfaces 27, 28 (FIG. 4) for the upper surface(s) 301 (FIGS. 3 and 4) of the mounting portion(s) 30.

FIGS. 1 and 7 disclose that the support portion 18 comprises projections or teeth 22 which form therebetween cut-out portions or notches 260. In this context, please see also FIGS. 5 and 6 which disclose a top plan view of the lower surface 121 of the contact element support 12. In particular FIG. 6 discloses a top plan view of the lower surface 121 in the area of the support portion 18 i.e. lower surface 21. Said recesses 25 can be referred to as first mounting means 25 of the contact element support 12. Preferably, said recesses 25 are formed at both sides of each notch 260 in said projections 22. A ridge 29 remains between each two recesses 25 of a projection 22.

Figure 8:
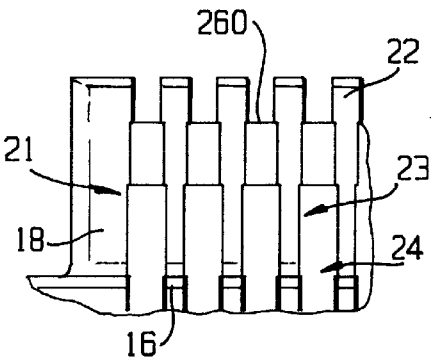
FIG. 8 is a detail X of FIG. 7.
Figure 6:
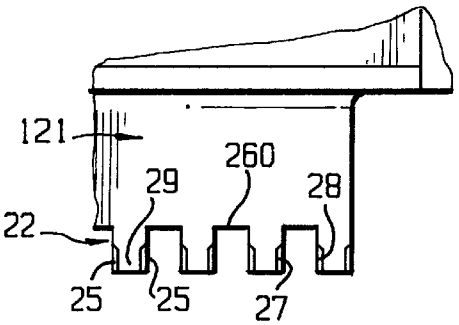
FIG. 6 is a detail Y of FIG. 5 disclosing first mounting means of the contact element support.
Figure 5:
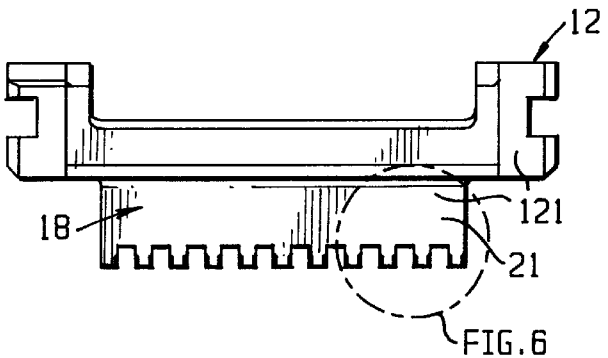
FIG. 5 is a top plan view of the contact element support of the connector of FIG. 1 onto its lower surface and without contact elements being inserted.

FIGS. 7 and 8 are top plan views of the upper surface 120 of the contact element support 12. FIG. 8 discloses in particular a top plan view of the upper surface 120 in the area of the support portion 18. It is noted that the ribs 16 comprise a rib extension portion 23 (in the area of the support portion 18) which becomes the projection 22. The rib extension portion 23 is on a slightly higher level than a contact element support surface 24 so that the upper surfaces of the contact elements 20 located on said contact element support surfaces 24 and the upper surfaces of the rib extension portions 23 are on the same level.

FIG. 9 discloses open contact chambers having the shape of gaps or notches 15 formed by said ribs 16. As can be noted, the chambers taper towards the bottom of the recess 15 so as to make the insertion of the comb 11 of contact elements 20 easier and to improve the fixation of the contact elements 20 (in said walls 26) at the time the comb 11 of contact elements 20 is horizontally moved after being vertically inserted in a manner yet to be described in more detail.

FIGS. 10 and 11 show the comb 11 of contact elements 20. The comb 11 of contact elements 20 comprises a plurality of contact elements 20.

FIG. 10 discloses the comb 11 of contact elements 20 right after stamping. FIG. 11 shows the comb 11 of contact elements 20 which is derived from the comb 11 of contact elements 20 shown in FIG. 10 by bending a part of the contact element 20 as is explained in more detail with reference to FIGS. 12 and 14.

Figure 12:
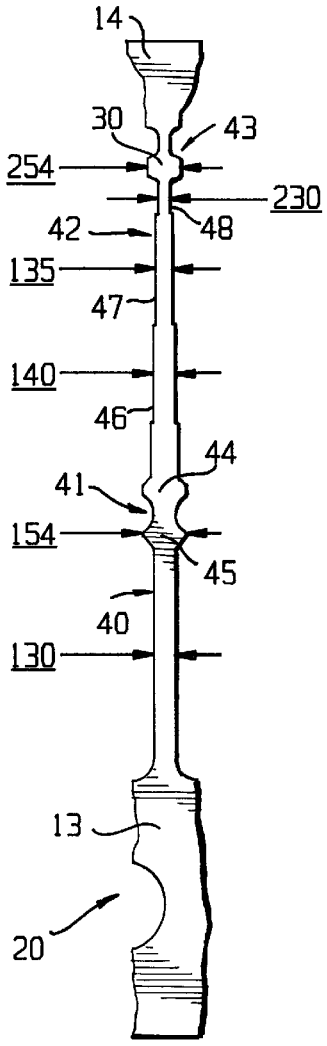
FIG. 12 shows an individual contact element prior to a bending or off-setting operation.

FIG. 11 shows that each of said contact elements 20 comprises: a termination section 40, adjacent thereto a mounting section 41 (forming a second contact element mounting means) and again adjacent thereto, an abutment section 42. Adjacent to the an abutment section 42 is a mounting section 43 (forming a first contact element mounting means). FIGS. 12 through 14 disclose a single contact element 20 which is in the representation of FIG. 12 not yet bent. In FIGS. 13 and 14 contact element 20 is shown in its bent position. As is shown, the contact element 20 is bent preferably twice by 90 degrees in the area of the mounting section 43. FIG. 12 discloses again the different sections 40–43 which had already been discussed with reference to FIG. 11. The width of the termination section 40 is referred to by reference numeral 130. Adjacent to the termination section 40, the mounting section 41 is formed in the embodiment shown by two expansions or claws 44, 45. Said transversely bulging claws or expansions 44, 45 have a greater width 154 than the width 130. Said claws 44, 45 can also be referred to as second mounting means of the contact elements (second contact element mounting means). The claws 44, 45 cooperate with the preferably slightly tapered walls 26 (see FIG. 9) of the spaces 15 between the ribs 16. Said walls 26 of the ribs 16 form second mounting means of the contact element support 12.

Continuing the description of FIGS. 10 through 14, it is noted that adjacent to the mounting section 41, the abutment section 42 is provided. The abutment or support section 42 (see FIG. 12) comprises abutment portions 46, 47 and 48 with preferably decreasing widths. The width 140 of the first abutment portion 46 is larger than the width 135 of the second abutment portion 47. The width 230 of the third abutment portion 48 is again smaller than the width 135. In the area of the third abutment portion 48, the formation of the mounting portion 30 takes place, preferably by bending the contact element twice by about 90 degrees, as is shown in FIG. 14. It is noted that the third abutment portion 48 has the smallest width compared with the widths 134 and 140. The widths 135 and 140 preferably correspond to the width 130. Adjacent to the third abutment portion 48, the mounting portion 30 (also called an expanded or widened portion 30) is provided. Said mounting portion 30 forms, as is shown in FIG. 14, an abutment surface 50 which cooperates with the abutment surfaces 27 and 28 of the contact element support 12. Said mounting portion 30 is also referred to as first mounting means of the contact element. In particular the abutment surfaces 27, 28 of the recesses 25 can (as is mentioned above) be referred to as first mounting means of the contact support 12. The width 254 of mounting portion 30 is larger width 230 of the third abutment or support portion 48.

FIGS. 15 and 16 show details of the design of the contact element support 12. In FIG. 15, one of the ribs 16 is shown which comprises, as all ribs 16, an inclined surface 70. Said rib 16 merges into said rib extension portion 23. The rib extension portion 23 drops in its level (see FIG. 4) down to a lower level forming firstly a somewhat narrower and then secondly a somewhat wider border portion 71 and 72, respectively In transverse direction adjacent to said border portions 71 and 72, the rib extension portion 23 forms a first somewhat wider and a second somewhat narrower support portion 60 and 61, respectively.

As outlined above, in accordance with the present invention, the connector 10 comprises first and second mounting means formed by the contact element support 12 and first and second mounting means formed by said contact element(s). The first and second mounting means of said contact element support 12 cooperate with the respective first and second mounting means of the contact element(s). The second mounting means of the contact element support 12 are preferably provided by the walls 26 of said ribs 16. Said first mounting means of the contact element support 12 are preferably provided at the lower surface of the contact element support 12 preferably at the lower surface 14 of the support portion 18.

The first mounting means of the connector, preferably provided at said contact element support 12, cooperate with first mounting means of the contact elements 20. Said second mounting means of the contact elements are preferably in the form of extensions or claws 44, 45.

Preferably, the cooperating second mounting means of the contact element support 12 and the second mounting means of the contact element provide for the mounting of the contact element 20 at a first or upper surface 120 of the contact element support 12.

Preferably, the first mounting means 25 of the contact element support 12 and the cooperating first mounting means 30 of the contact elements 20 provide for a mounting of the contact element 20 at a side of the contact element support 12 which is distant from where the second mounting means 44, 45 of the contact elements provide for a fixation. Preferably, the first mounting means provide a fixation for the contact elements 20 at the lower surface of said contact element support. Most preferably, the first mounting means 30 cooperate with the lower surface of the support portion 18. More specifically, the first mounting means 30 cooperate with the support portion 18 in the area of the projections 22 which are unitary with the support portion 18.

In accordance with the assembly method of the invention, a comb 11 of contact elements 20, as shown in FIG. 11, is provided. This comb 11 is inserted with its termination section 40 into the spaces of the comb 11 formed by the ribs 16 of the contact element support 12. Preferably, during said insertion, the contact elements 20 remain connected at both sides with the pilot strips 13 and 14. After the comb 11 of contact elements 20 is inserted up to the bottom of the spaces or gaps 15, the comb 11 of contact elements 20 is moved horizontally with respect to the contact element support 12 so that the claws or claw means 44, 45 cut into the walls 26 of the ribs 16 of the contact element support 12, thus fixedly mounting said contact elements 20 in the contact element support 12.

Simultaneously, during the horizontal movement of the comb 11 of contact elements 20, the mounting portions 30 are anchored at the bottom surface 121 of the contact element support 12, i.e. the upper sides 301 (FIGS. 4 and 14) of the mounting portions 30 come into engagement with the abutment surfaces 27, 28 at the bottom surface 121 adjacent to said projections 22. Thus, the contact elements 20 are protected against a vertical release from the contact element support 12.

| Reference character list | |
|---|---|
| 10 | connector (e.g. male) |
| 11 | comb of contact elements |
| 12 | contact element support |
| 13 | pilot strip |
| 14 | pilot strip |
| 15 | space or gap |
| 16 | ribs |
| 17 | support or mounting portion |
| 18 | support portion |
| 19 | notch |
| 20 | contact element |
| 21 | lower surface of support portion 18 |
| 22 | projection, teeth |
| 23 | rib extension portion |
| 24 | contact element support surface |
| 25 | recess |
| 26 | wall of rib |
| 27 | abutment surface |
| 28 | abutment surface |
| 29 | ridge |
| 30 | mounting portion; expansion |
| 40 | termination section |
| 41 | (wider) mounting section |
| 42 | (narrower) support section |
| 43 | (wider) mounting section |
| 44 | expansion, claw means, wider section |
| 45 | expansion, claw means |
| 46 | first support portion |
| 47 | second support portion |
| 48 | third support portion |
| 50 | abutment surface of the angled portion or section |
| 60 | first support section |
| 61 | second support section |
| 70 | inclined surface |
| 71 | first border portion |
| 72 | second border portion |
| 120 | first and upper surface |
| 121 | second and lower surface |
| 130 | width |
| 135 | width |
| 140 | width |
| 154 | greater width |
| 230 | width |
| 254 | width |
| 260 | notches |

What is claimed is:

1. A connector, comprising:

(a) a contact element support including a first surface comprising ribs including walls which define spaces therebetween and a second surface opposite said first surface and comprising recesses; and (b) a plurality of electrically conductive contact elements, each of said contact elements including a strip including claws adapted to cooperate with said walls defining said spaces, and a mounting portion connected to said strip and adapted to cooperate with said recesses provided in said second surface;

wherein said contact element support comprises a mounting part and an abutment part, both parts being formed as a single piece from plastic material, wherein said abutment part comprises projections at an end thereof projecting away from said mounting part, said projections being located in the extension of said rib extension portions and being formed by them;

wherein said projections define recesses adapted to receive and hold the mounting portion.

2. The connector of claim 1, wherein the mounting portions are formed by bending said contact elements such that the mounting portions are located in a plane which is off-set in substance parallel with respect to the plane which contains said claws.

3. The connector of claim 1, wherein the mounting portion comprises two oppositely located projections located in a plane parallel but different from the plane where the claws are located.

4. The connector of claim 1, wherein the connector is a male connector and the termination section of a plurality of contact elements is arranged in a plane with the contact elements being spaced in said plane and supported by a support portion of said contact element support.

5. The connector of claim 1, wherein said contact elements are bent about 90 degrees in the area of cut-out portions of said abutment portion.

6. The connector of claim 1, wherein at the upper surface of the contact element support rib extension portions are provided which are on a higher level than support surfaces which extend between said rib extension portions.

7. The connector of claim 6, wherein said support surfaces have different widths defined by the widths of said rib extension portions.

8. The connector of claim 1, wherein the contact elements are elongated and comprise:

a termination section, a second mounting section adjacent thereto, an abutment section and adjacent thereto a second mounting first.

9. The connector of claim 8, wherein the abutment section of each contact element comprises three abutment portions comprising different width, preferably having a decreasing width such that the third abutment portion has the smallest width.

10. The connector of claim 8, wherein the contact elements have a smaller width in the termination section than in the second mounting section.

11. The connector of claim 10, wherein in said second mounting section said mounting means are provided in the form of claws.

12. The connector of claim 11, wherein the contact element comprises in the plane of the contact element of the second mounting section each two claws, each of said claws being formed by two projections located in said plane of the contact element.

* * * * *

UNITED STATES PATENT AND TRADEMARK OFFICE

CERTIFICATE OF CORRECTION

PATENT NO. : 6,280,260 B1
DATED : August 28, 2001
INVENTOR(S) : Michael Bertsch

It is certified that error appears in the above-identified patent and that said Letters Patent is hereby corrected as shown below:

Column 3,
Line 8, after "degrees" insert a period -- . --;
Line 27, change "15S" to -- 15 --;
Line 51, change "18-" to -- 18 --.

Column 5,
Line 24, after "respectively" insert a period -- . --

Signed and Sealed this

Twenty-fifth Day of May, 2004

JON W. DUDAS
*Acting Director of the United States Patent and Trademark Office*